US005831397A

United States Patent [19]

Stevens et al.

[11] Patent Number: 5,831,397

[45] Date of Patent: Nov. 3, 1998

[54] DEFLECTING APPARATUS FOR A FLAT-PANEL DISPLAY ILLUMINATED BY ELECTRONS

[75] Inventors: Jessica L. Stevens, San Mateo; W. Edward Naugler, Menlo Park, both of Calif.

[73] Assignee: Telegen Corporation, Redwood City, Calif.

[21] Appl. No.: 753,825

[22] Filed: Dec. 2, 1996

[51] Int. Cl.[6] ..... H01J 29/70; H01J 29/72

[52] U.S. Cl. ..... 315/366; 313/422

[58] Field of Search ..... 315/366; 313/422, 313/396, 453, 302

[56] References Cited

U.S. PATENT DOCUMENTS

| | | | |
|---|---|---|---|
| 3,746,909 | 7/1973 | Runtzel et al. . | |
| 4,794,306 | 12/1988 | Tischer et al. | 313/422 |
| 4,973,888 | 11/1990 | Morimoto et al. | 315/366 |
| 5,436,530 | 7/1995 | Suzuki et al. | 315/366 |

*Primary Examiner*—Theodore M. Blum
*Attorney, Agent, or Firm*—William J P Weiland

[57] ABSTRACT

A deflecting apparatus for a flat-panel display having an evacuated display housing and a display screen. The display has phosphor stripes or dots for generating visible radiation when bombarded with electrons when accelerating voltage $V_1$ is applied to stripes. The invention provides for an elongate electron source positioned in the back of the evacuated display housing for emitting electrons which are guided to the display screen through an anode grid or an electron gating grid located before the display screen. The deflecting apparatus for rendering the beam of electrons emitted from the elongate electron source uniform has a deflecting element or unit which is positioned at the back of the display housing and produces a spatially parabolic potential under the influence of steering potential $V_4$. This spatially parabolic potential forces the electrons moving in the direction of the anode grid or gating grid to form a uniform beam. The deflecting apparatus of the invention can also be used to focus electrons to a narrow beam forming a "knife edge".

14 Claims, 6 Drawing Sheets

DEFLECTING APPARATUS FOR A FLAT-PANEL DISPLAY ILLUMINATED BY ELECTRONS

BACKGROUND—FIELD OF THE INVENTION

The present invention relates to the field of visual display indicators and display panels using low-energy electrons for illumination, and in particular to a deflection mechanism for use with such displays to produce a broad uniform beam of electrons, or a narrow, guided beam of electrons.

BACKGROUND—DESCRIPTION OF PRIOR ART

Fluorescent display systems which indicate characters, signs, figures in the form of dotted or pixel patterns are well known in the prior art. Usually these system employ light emissive materials, e.g., a phosphor, which emits light when impinged by electrons. Generally, displays operating according to this technique employ an electron source called the cathode, a mechanism for controlling the electrons produced by the cathode, and a phosphor target on which the electrons are caused to impinge. It is the emission of visible light in shapes or patterns of the phosphor which communicates a message to the viewer.

Typically, the phosphors are deposited on a matrix of electrodes called anodes. The anodes can be maintained at high positive voltages relative to the cathode to attract and accelerate to light emission energies the negatively charged electrons. A control system is usually positioned between the cathodes and the anodes to determine which phosphor-coated element of the matrix is impinged with electrons to generate light.

Numerous sources are available for generating the electrons for such displays. Some of the common methods are based on cold cathode field emission, light stimulated electron emission, plasma generation and thermal generation of electrons. Among the most convenient sources for generating electrons for such displays are linear sources, e.g., filaments. Unfortunately, a serious problem arise when linear sources are used to generate electrons and distribute them over a large display surface. When accelerated by a broad surface phosphor/anode the electrons impinge on the display surface according to a fringe-like pattern. This result is sometimes called the "washboard effect" and is characterized by strips of light and dark areas running parallel with the filaments.

The "washboard effect" is a recognized and serious problem. Various attempts have been made to produce a uniform beam of electrons and eliminate this effect.

In his U.S. Pat. No. 4,719,388 Oess produces thermal electrons and confines them between two electrodes which repel the electrons back and forth. In effect, the electrons are imprisoned in a cloud between the electrodes. The central idea is to ensure that the electron cloud has no potential gradient along its edges. If this occurs then the cloud is uniform and electrons drawn from the cloud may be expected to impinge on the display area in a uniform fashion.

Unfortunately, whenever any electrons are drawn from the cloud to activate the display the delicately balanced electric forces between the electrode plates are upset and non-uniformities result. This is especially true if large amounts of electrons are to be drawn at the same time. Consequently, the solution proposed by Oess does not work for a dynamic panel display and has not been incorporated into panel display technologies.

In U.S. Pat. No. 4,525,653 Smith teaches how to isolate each filament between field plates. The problem with this invention is that the field plates limit the resolution of the display. Moreover, the electron trajectories conditioned by the geometry do not translate into a uniform electron beam.

Hant uses a flat field plate positioned behind the filaments to "spread" the electrons. This technique is described in U.S. Pat. No. 3,956,712. While this configuration does spread the electrons, it does not do so evenly. Therefore, the cross section of the electron beam is not uniform.

Runtzel et al. in U.S. Pat. No. 3,746,909 does propose an area electron flood gun which renders the beam of electrons uniform. A parabolic deflector or dish is used to reflect electrons emitted from a filament. The dish is maintained at a voltage higher than the voltage of the filament. A mesh at a still higher voltage is positioned a the output of this device. Although this device has some promising features, it is not operable because of the progressively higher voltages applied to the filament, deflector, and front mesh. In particular, electrons emitted from he filament will collide and be absorbed by the parabolic deflector. The field strengths between filament, front mesh and parabolic deflector do not become equal until the parabolic deflector is very close to the emitter. This means that over half of the electrons emitted from the filament will collide with the parabolic deflector rather than form a uniform beam. In addition, this system is not suited for use with displays.

Additional patent literature addresses focusing and guiding electrons in geometrical configurations where electrons are provided from sources positioned laterally from the screen or from remote point sources. Theses solutions are not dimensionally compact and thus not useful in modern displays (especially flat-panel displays).

Thus, there is a need for a system which can homogenize the stream of electrons emitted from an electron source. Such system should be able to render the electron beam cross section uniform at the display screen to eliminate the "washboard effect". Furthermore, such apparatus must be adapted for use in flat-panel displays. It should also be small, simple to build, and easy to control.

OBJECTS AND ADVANTAGES OF THE INVENTION

In view of the shortcomings of prior art the first object of the present invention is to eliminate the "washboard" effect by providing a uniform electron beam which is not affected by the dynamic operating conditions.

Another object of the invention is to provide an apparatus capable of providing a uniform electron beam cross section for flat-panel displays. This apparatus should work with displays of the type having an evacuated housing, an electron source a the back of the housing and a front display.

Still another object of the invention is to provide for a uniform electron beam with an apparatus which is compact, simple to build, and easy to operate. In particular, the apparatus should require few control voltages which can be easily generated and applied.

Yet another object of the invention is to provide an apparatus with capability of changing the electron beam of uniform cross section into "knife edge" of focused electrons which can be steered by the apparatus by applying various voltages.

These and other objects and advantages will become more apparent after consideration of the ensuing description and the accompanying drawings.

SUMMARY OF INVENTION

The objects and advantages of the invention are ensured by the deflecting apparatus for a flat-panel display having an evacuated display housing in which the display screen is on the front face. In a typical display of this kind the display screen has phosphor stripes or dots for generating visible radiation when bombarded with electrons. The phosphor stripes or dots which are maintained at an accelerating voltage $V_1$ by means of a suitable voltage source attract electrons, causing them to release light from the phosphors upon impact.

The invention further provides for an elongate electron source positioned in the back of the evacuated display housing. This electron source emits electrons which are guided to the display screen. An anode grid or an electron gating grid, depending on the type of display, is located before the display screen. Both types of display have an arrangement for applying predetermined to the anodes. In the case of the anode grid the arrangement is designed to apply a voltage which will allow electrons emitted by the electron source to pass through the grid, and, in particular, certain portions of the grid and travel in the direction of the display screen. The gating grid has a plurality of conductive filaments oriented in parallel. Like the anode grid, the gating grid is also positioned before the display screen. The control system for the gating grid selectively applies a blocking voltage $V_2$ and a gating voltage $V_3$ to the conductive filaments, such that the gating voltage $V_3$ is simultaneously applied to an adjacent filament pair. As a result, the electrons pass in-between the adjacent filament pair and continue to travel in the direction of the display screen.

The deflecting apparatus for rendering the beam of electrons emitted from the elongate electron source uniform has deflecting element or unit positioned at the back of the display housing. The deflecting element is located at distance T below the anode grid or the electron gating grid. The elongate electron source is positioned forward of the deflecting element, such that the deflecting element faces the electron source. The deflecting apparatus also has a voltage control means for applying a steering potential $V_4$ tp deflecting element. Under the influence of steering potential $V_4$ the deflecting element produces a spatially parabolic potential. This spatial potential forces the electrons moving in the direction of the anode grid or gating grid to form a uniform beam.

The deflecting element can consist of any number and arrangement of electrodes capable of producing a spatially parabolic potential. In one embodiment the deflecting element is made of a number n of stripes positioned in parallel with the elongate electron source. The stripes can vary in width. Also individual potentials $V_{4i}$, where i=1 . . . n, are applied to the stripes to generate the requisite parabolic potential.

It is important for proper functioning that distance T is chosen such that the electron beam has uniform cross section when passing through the anode grid or the gating grid. In a preferred embodiment the elongate source of electrons is a filament. The filament is heated to emit thermal electrons. The filament can extend along the focal line of the spatially parabolic potential. The spatial location of the most uniform part of the electron beam depends on proper integration of potential on the deflecting apparatus, the filament, the grids, and the anode. These voltages are dependent on the voltages required to operate the phosphors. In another embodiment the deflecting apparatus is a metallic, parabolic deflector positioned at the back of the display housing a distance T below the anode grid or gating grid. Again, the electron source, e.g., filament, is located forward of the parabolic deflector. A voltage source maintains the parabolic deflector at steering potential $V_4$, thus resulting in a spatially parabolic potential. As before, this forces the electrons moving in the direction of display screen to form a uniform beam.

The deflecting apparatus of the invention can also be used to focus electrons to a narrow beam. Such beam creates a "knife edge" an can be used to scan a flat-panel display.

A better understanding of the invention will be gained upon reading the following specification which makes references to the attached drawing figures.

DESCRIPTION

Figure 1:
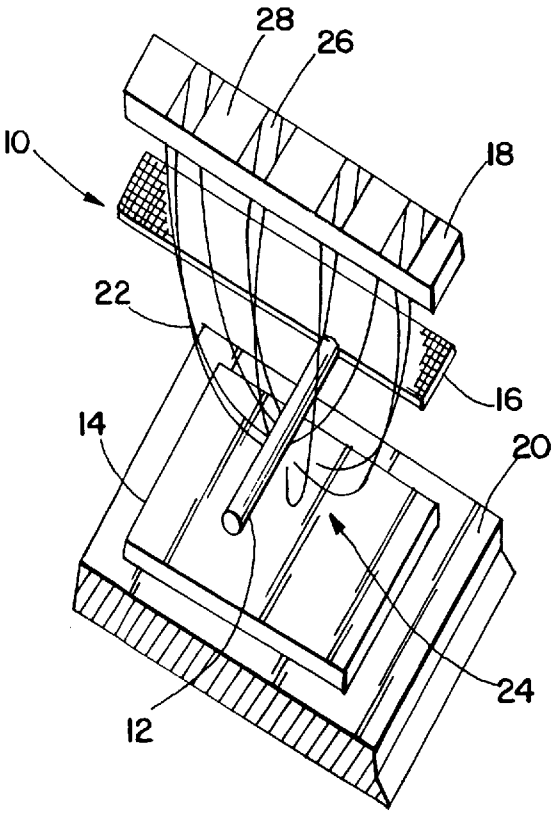
Fig. 1 (PRIOR ART)
FIG. 1 illustrates a typical prior art electron guidance system.

The present invention will be best understood after a brief review of the prior art. FIG. 1 illustrates a typical system for guiding electrons with the aid of a deflecting apparatus. For reasons of clarity, only a portion of the system is shown in the drawing. In particular, an electron guidance apparatus 10 has an electron source 12 positioned centrally above a deflecting plate 14. Typically, electron source 12 is a thermionic filament. An anode grid or mesh 16 is positioned above filament 12. A phosphor stripe 18 (in a practical display an array of similar stripes is provided), is positioned above mesh 16. A portion of a base or housing 20 is shown below deflecting plate 14. Usually, housing 20 encases entire apparatus 10 and ensures a good vacuum.

During operation a voltage is applied to thermionic filament 12 such that it emits electrons. At the same time, deflecting plate 14 is maintained at a negative voltage with respect to thermionic filament 12. This causes electrons emitted from thermionic filament 12 to be reflected upward and travel to anode mesh 16. By virtue of being maintained at a positive potential, anode mesh 16 attracts the electrons and causes them to pass through in the direction of phosphor stripe 18. A few representative electron paths are indicated in the drawing by reference 22. The electrons which pass through anode mesh 16 impinge on phosphor stripe 18 and cause it to emit visible radiation.

The problem in apparatus 10 arises because the electrons couple not only to the external field generated by deflection plate 14, but also to each other. The effects responsible for this coupling are of quantum-mechanical nature. As a result, electron paths 22 are not distributed uniformly in space. In other words, the cross-section of an electron beam 24 made up of the electrons following along paths 22 is non-uniform. This produces the "wash board" effect on phosphor stripe 18. Light regions 26 correspond to areas on stripe 18 where a large number of electrons tend to impact. Dark regions 28 do not receive enough electrons. It should be noted, that the "wash board" effect produces more that one bright spot, i.e., more than the one directly above thermionic filament 12.

Figure 2:
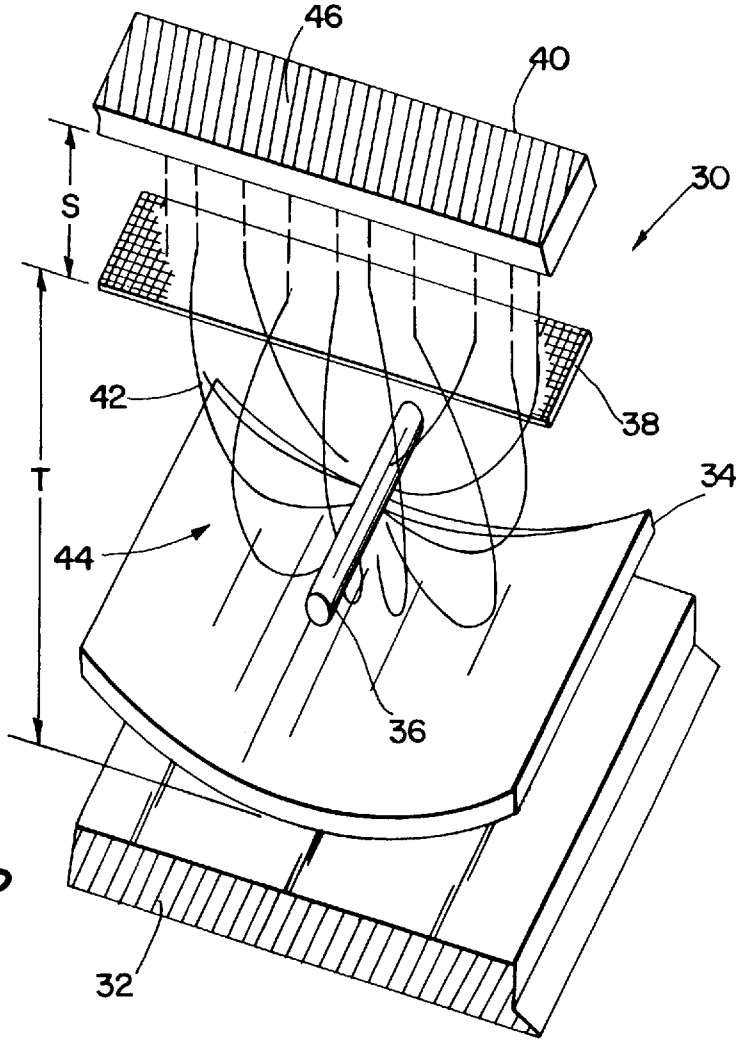
FIG. 2 is a simplified deflection apparatus according to the invention.

FIG. 2 shows a simplified deflecting apparatus 30 according to the invention. Apparatus 30 is mounted in a light emissive display, of which the only portion indicated in FIG. 2 is back wall 32. It is important, however, that the space inside the display be evacuated, as the presence of particles, especially charged ones, presents an obstacle to proper operation of apparatus 30. A parabolic deflector 34 is positioned above back wall 32. Deflector 34 is made of a metallic material or some other material which can be maintained at a desired voltage potential. A thermionic filament 36 is arranged above deflector 34. It is preferable that thermionic filament 36 be of the type which emits thermal electrons in reaction to an electric current. Furthermore, filament 36 may extend along the focal line of parabolic deflector 34 as indicated in FIG. 2.

A grid 38 is located above thermionic filament 36. In particular, the arrangement of grid 38 is such that deflector 34 is located a certain distance T below it. The method of selecting distance T will be addressed below. A phosphor stripe 40 is positioned above grid 38. There are two general types of phosphor stripes known in the art: electrically conducting and non-conducting. Either type can be used in the apparatus of the invention. In the case of a non-conductive stripe an additional electrode (not shown) will be provided for applying an accelerating voltage $V_1$ to phosphor stripe 40. When using a conducting stripe 40 accelerating voltage $V_1$ is applied directly to stripe 40. The distance between grid 38 and stripe 40 is designated by S.

Deflecting apparatus 30 is operated by applying a steering potential $V_4$ to parabolic deflector 34 and applying sufficient heating current to filament 36 to cause it to emit electrons. Once released from filament 36, the electrons experience the electric field due to steering potential $V_4$ on deflector 34. Because of the parabolic shape of deflector 34 the potential is spatially parabolic. This causes the electrons to be reflected and deflected upward, depending on their initial velocity vector, in the direction of grid 38.

In fact, the spatially parabolic nature of the potential compels electrons to follow along trajectories or paths 42 which cross in a manner fundamentally different from that observed in prior art apparatus 10. The result of altered electron trajectories 42 is an electron beam 44 which forms a uniform cross section at a distance T above deflector 34. This means that all non-uniformities in electron be am 44 are eliminated by the time the electrons reach grid 38. Thus, electron beam 44 passing through anode grid 38 is uniform.

Once past grid 38, electrons of beam 44 are accelerated by accelerating voltage $V_1$ applied to phosphor stripe 40. In the example shown all sections of grid 38 are maintained at a voltage which accelerates and passes the electrons for demonstration purposes. The accelerating voltage $V_1$ is sufficiently large to ensure that the cross-section of electron beam 44 remains uniform between grid 38 and stripe 40, i.e., over distance S. Thus, the electrons impinge on te entire surface of stripe 40. No "wash board" effect is observed in this case, as shown by light region 46 extending across entire stripe 40. Of course, if only certain sections of grid 38 are maintained at a voltage which permits the electrons to pass, then the corresponding areas of stripe 40 will be illuminated. No "wash board" effect is observed in those areas either.

In addition to proper placement of thermionic filament 36, deflector 34, and grid 38, the above result is also contingent on proper selection of voltages. The appropriate choice of values for steering voltage $V_4$, voltages on grid 38, and accelerating voltage $V_1$ is thus crucial. These values can be determined empirically, however, because of the many variables involved, they can be most efficiently calculated according to the below method.

Appropriate voltages can be calculated using a recursive, numerical method easily implemented with the aid of a computer. The particular method disclosed herein is exemplary, and it is understood that a person of average skill in the art will be able to develop other programs to derive the appropriate voltages.

First the program calculates three positions, the initial position and two subsequent positions, of ten electrons having initial energies corresponding to these measured upon emission from thermionic filament 36. These energies will vary depending on the type of material of filament 36 and the current used to trigger electron emission therefrom. The behavior of these ten electrons under the influence of a test value steering voltage $V_4$ is then modeled numerically to derive the two subsequent positions. These positions are mapped in the complex plane, where the x-component is the real part and the y-component is the imaginary part. This is convenient, since complex numbers are mathematically equivalent to two-dimensional vectors, and since geometry of apparatus 30 is two-dimensional (longitudinal) only two-dimensional vectors are required. In the next cycle one of the subsequent positions is chosen as the initial position and the calculation is repeated. For best results the cycles should be very short, e.g., on the order of a fraction of a nanosecond. It is understood that the numerical method gives approximate answers to the three positions and that some final adjustment to positions and voltages must be made experimentally to yield the best results.

In one particular example the parabola of deflector 34 was described by the equation $y=a(x-h)^2+k$. Thermionic filament 36 was placed at the focal point of the parabola. The actual program with explanation of the individual steps and with actual dimensions is included in Appendix A to this application.

Figure 3:
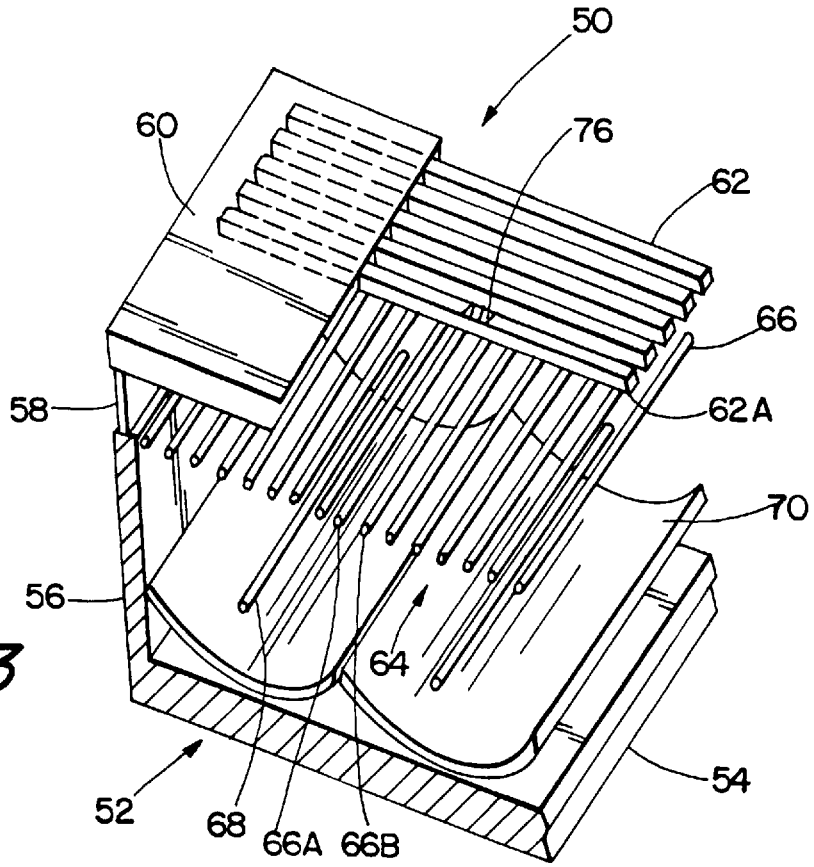
FIG. 3 is a preferred deflection apparatus according to the invention mounted in a flat-panel display.

FIG. 3 illustrates how the invention is adapted for use in a flat-panel display 50. In the preferred embodiment, a display housing 52 of display 50 has a floor or back 54, a side wall 56 and spacer 58. A display screen 60 is located on the front face of display housing 52. In order to ensure good operation, housing 52 has to be evacuated. Particles, charged or uncharged, found inside the housing will impede the flight of electrons and thus interfere with proper functioning of display 50.

A number of phosphor stripes 62 are embedded inside display screen 60. Stripes 62 are parallel to each other and spaced as closely as dictated by resolution requirements. The phosphors of stripes 62 can be conducting or non-conducting. An additional conductor, e.g., a conducting stripe (not shown) running along each stripe 62, will be required if non-conducting phosphors are used. Accelerating potential $V_1$ will be applied to this conducting stripe using a voltage source 73. In the preferred embodiment discussed here phosphors are assumed to be conducting for simplicity and source 73 is used to apply accelerating voltage $V_1$ directly to each stripe 62.

An electron gating grid 64 made up of individual conducting elements 66 is positioned before screen 60. In a different embodiment gating grid 64 can be replaced by a mesh as described in the simplified embodiment of FIG. 2. However, using gating grid 64 is particularly advantageous in electron-driven flat-panel displays. An elongate electron source 68, in this case a thermionic filament 68, is positioned at the back of housing 52. In the drawing two filaments 68 are shown mounted in parallel. An actual display may have a large number of filaments 68, but each filament 68 will have associated with it a deflecting element 70 located at the back of housing 52.

In preferred embodiment element 70 is a parabolic deflector positioned a distance T below grid 64 such that filament 68 extends above deflector 70. In some cases it is advantageous to arrange filament 68 along the focal line of deflector 70.

Figure 4:
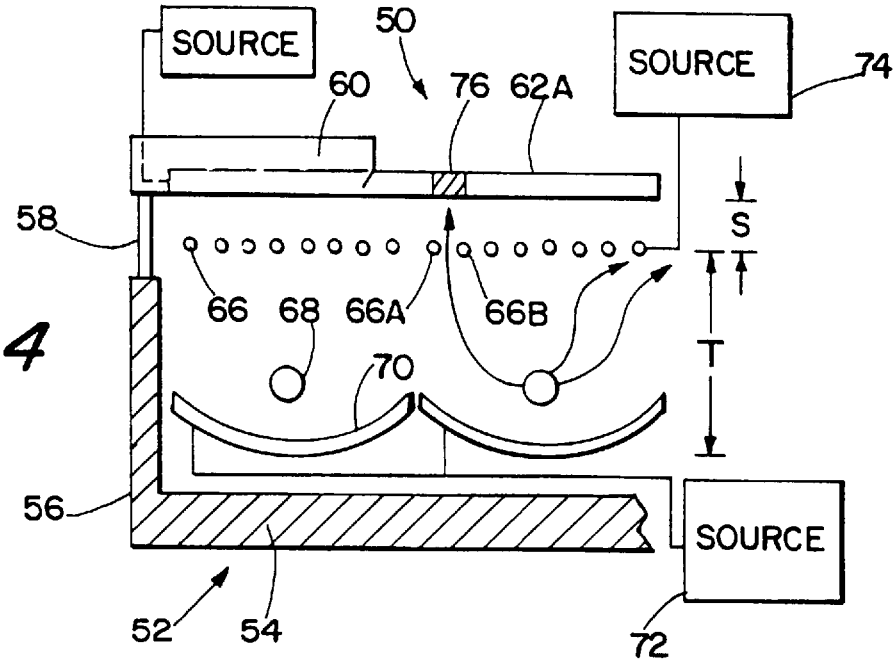
FIG. 4 is a front cross-sectional view of FIG. 3.

As shown in FIG. 4, a voltage control unit or source 72 is connected to each deflector 70. The electrical connections are such that a steering potential $V_4$ can be applied to each deflector 70. In some special cases, on may choose to only apply steering potential $V_4$ to a select number of deflectors 70, e.g., to only activate the corresponding portions of screen 60. A voltage source 74 is also connected to each conductive filament 66 of gating grid 64. Voltage source 74 is set up to selectively apply a blocking voltage $V_2$ and a gating voltage $V_3$ to conductive filaments 66.

During operation thermionic filament 68 emits electrons. Steering voltage $V_4$ is applied to deflector 70 and a spatially parabolic potential is created, as described above. The electrons are thus directed in a beam to gating grid 64. As in the simplified example of FIG. 2, the electron beam cross section at grid 64 is uniform.

To pass electrons between a pair of adjacent conductive filaments 66 gating voltage $V_3$ has to be applied to both. To stop electrons from passing to display screen 60 blocking voltage $V_2$ has to be applied to the corresponding conductive filaments 66. For example, only conductive filaments 66A and 66B are maintained at gating voltage $V_3$ and the remaining filaments 66 are held at blocking voltage $V_4$. At the same time, accelerating voltage $V_1$ is applied to phosphor stripe 62A. As a result, portion 76 of stripe 62A is bombarded by electrons and lights up. Electrons traveling in the direction of other filaments 66 will be deflected as shown by the broken arrows. In practice, portion 76 can correspond to a display pixel. The appropriate gating and blocking voltages $V_3$ and $V_4$ can be determined experimentally. Blocking voltage $V_4$ is usually set at 0 V or some other voltage which is lower than that on filament 68. Gating voltage $V_3$ is considerably higher than the voltage on filament 68, and frequently just slightly lower than accelerating voltage $V_1$. The actual numerical values can be determined with a recursive method.

Figure 5:
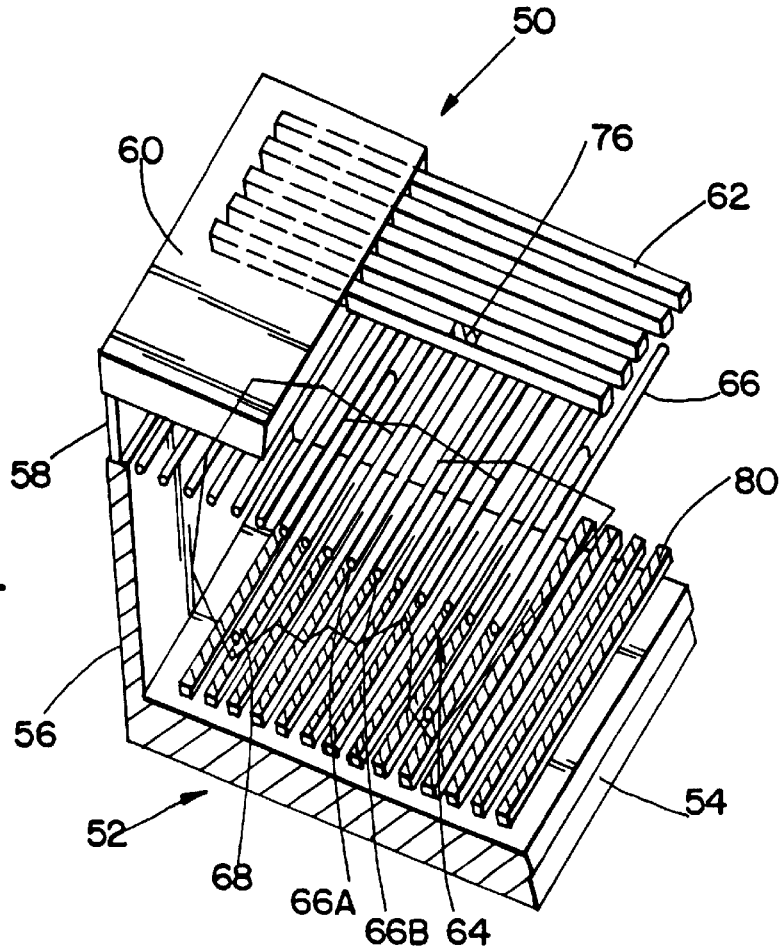
FIG. 5 is another deflection apparatus according to the invention mounted in a flat-panel display.
Figure 6:
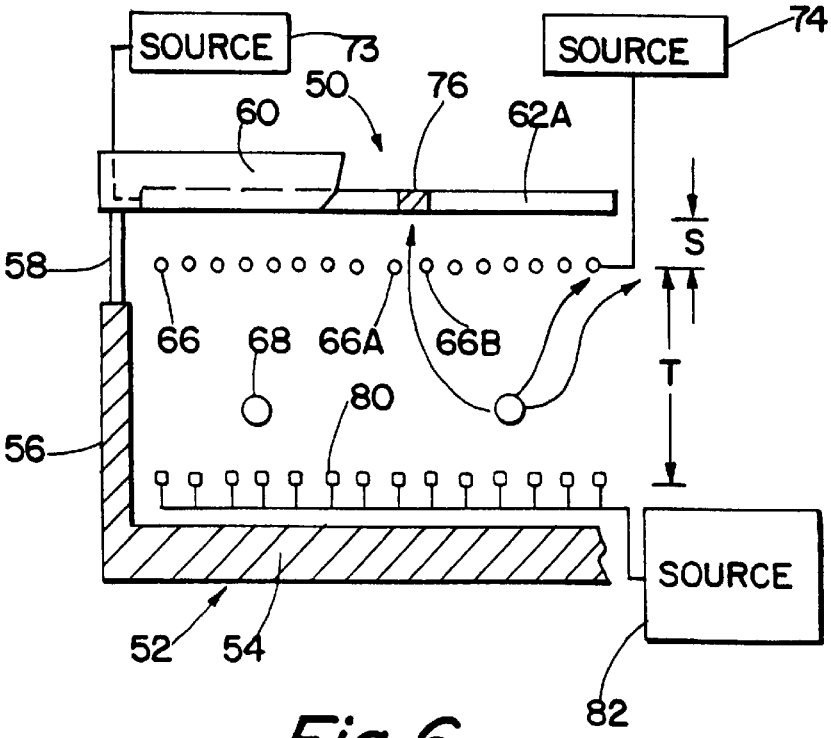
FIG. 6 is a front cross-sectional view of FIG. 5.

FIGS. 5 and 6 show an embodiment very similar to the preferred one, with a different deflecting arrangement. In this case, parabolic deflectors 70 are replaced by individual stripes 80. Stripes 80 are made of and electrically conductive material, such steering potential $V_4$ can be applied to them. The number of stripes n associated with each thermionic filament 68 will depend on the desired resolution of display 50. In general, the more stripes 80 are used, the closer one can approximate the spatially parabolic potential.

Stripes 80 are connected to voltage source 82, which can maintain each stripe at a different voltage. In other words, each stripe can be held at an individual potential $V_{4i}$, where i=1 . . . n. In FIGS. 5 and 6 there are seven stripes 80 associated with each thermionic filament 68 (n=7).

In practice, the effect of stripes 80 is the same as that of parabolic deflector 70 when individual potentials $V_{4i}$ are chosen such that a spatially parabolic potential is created. The operation of this embodiment is analogous to that of the preferred embodiment.

Figure 7:
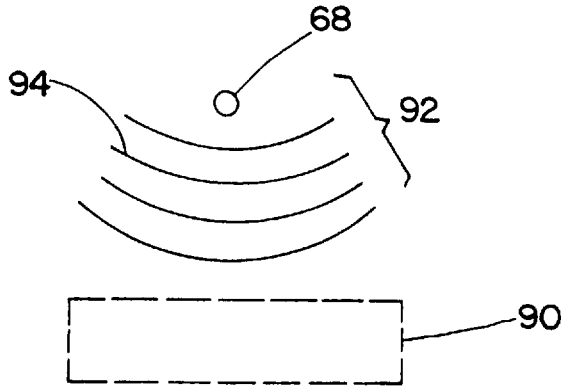
FIG. 7 is a diagram of a spatially parabolic potential.

As visualized in FIG. 7, many different arrangements of conductors generally referred to by reference 90 can be used to set up a spatially parabolic potential 92. A number of equipotential lines 94 indicate where the voltages are equal in magnitude.

Figure 8A:
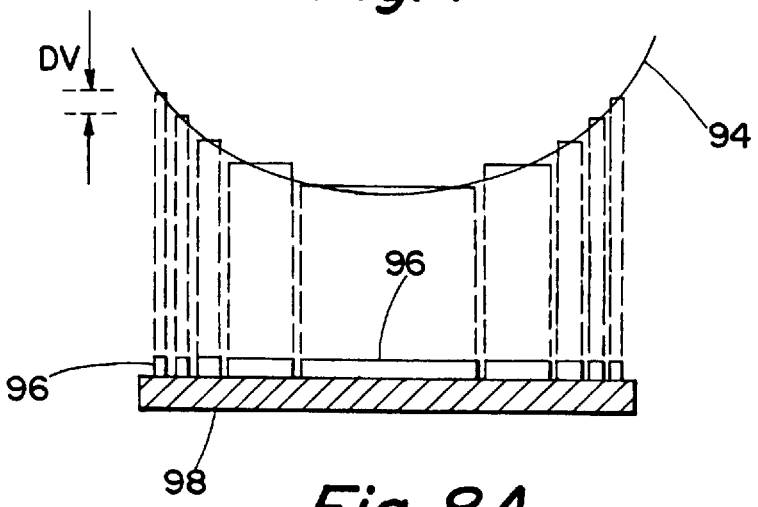
FIG. 8A is a cross-sectional view of unequal stripes for producing a parabolic potential.

FIGS. 8A–8E shows some exemplary arrangements of conductors used for generating spatially parabolic potential 92. In FIG. 8A stripes 96 of variable width are used to generate parabolic potential 92. The difference between voltages $V_{4i}$ is chosen to be constant and equal to $\Delta V$, as indicated in the drawing. In this manner continuous parabolic potential is approximated in discrete "steps". FIG. 8A shows how this approximation works for one equipotential line 94. Stripes 96 can be deposited on a substrate 98, as shown, or, alternatively, on back 54 of display 50. According to other techniques, stripes 96 can be etched or produced by lithographic means. A person skilled in the art will be able to produce stripes 96 on suitable substrate 98.

Figure 8B:
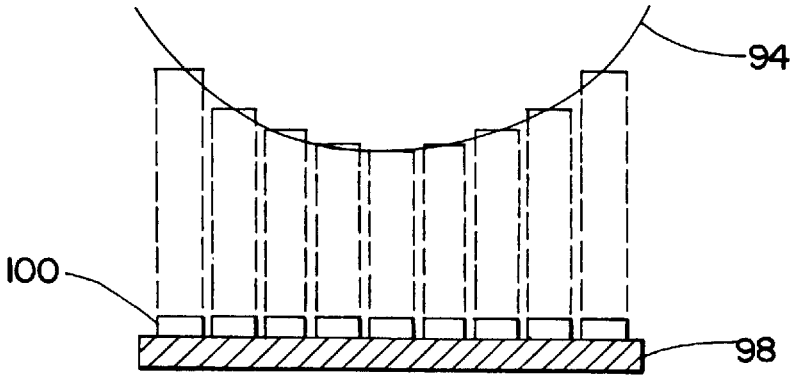
FIG. 8B is a cross-sectional view of equal stripes for producing a parabolic potential.

FIG. 8B illustrates stripes 100 of a conducting material deposited on a substrate 98. In this case all stripes 100 have the same width. The difference between voltages $V_{4i}$ is not he same in this situation. This constraint is imposed because all stripes 100 are of equal width.

Figure 8C:
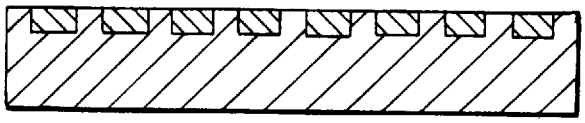
FIG. 8C is a cross-sectional view of an embedded stripes for producing a parabolic potential.
Figure 8E:
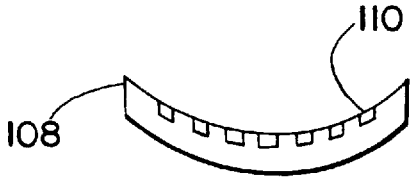
FIG. 8E is a cross-section view of parabola with stripes for producing a parabolic potential.
Figure 8D:
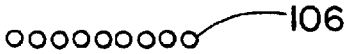
FIG. 8D is a cross-sectional view of wires for producing a parabolic potential.

In FIG. 8C a number of stripes 104 of equal width is embedded inside an insulating substrate 102. This solution protects stripes 104 from external damage. A different approach yet shown in FIG. 8D, where stripes 106 are n the form of conducting wires. This arrangement is particularly simple since wires 106 can be suspended between sets of two posts on floor 54 of display housing 52. Finally, FIG. 8E illustrates a deflector 108 with embedded stripes 110. This solution allows for most accurate control of spatially parabolic potentials.

Figure 9:
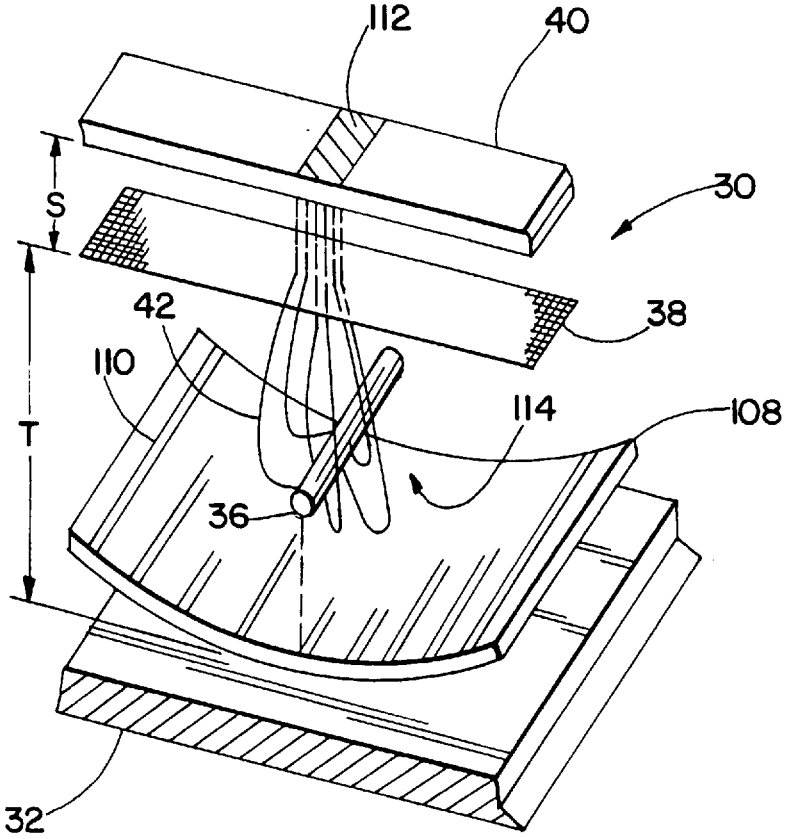
FIG. 9 is an embodiment for producing a "knife edge" electron beam.

Yet another embodiment of the invention is shown in FIG. 9, which uses some of the same elements as FIG. 2. Hence, the same reference numbers are used to denote corresponding parts. In this embodiment the deflecting element is that of FIG. 8E. Individual voltages $V_{4i}$ applied to stripes 110 of deflector 108 are very large, e.g., on the order of 300 Volts or more. This causes electron paths 42 to be squeezed together or compressed to form a tight beam 114. In fact, with a sufficiently high voltages $V_{4i}$ the electrons can be compressed to a line of 112 or "knife edge" by the time they reach phosphor stripe 40.

In FIG. 9 the electrons are compressed to impact only a small region such that line 112 corresponds to a pixel on phosphor stripe 40. Of course, voltages applied to mesh 38 are such as to aid in the process. In particular, the voltage applied to mesh 38 where beam 114 passes through it is very high, while the voltage along the remainder of mesh 38 is low. As in the previous embodiments, phosphor stripe 40 is maintained at accelerating potential $V_1$. The actual voltages best suited to produce "knife edge" 112 can be determined with the recursive method disclosed above and adjusted experimentally.

Figure 10:
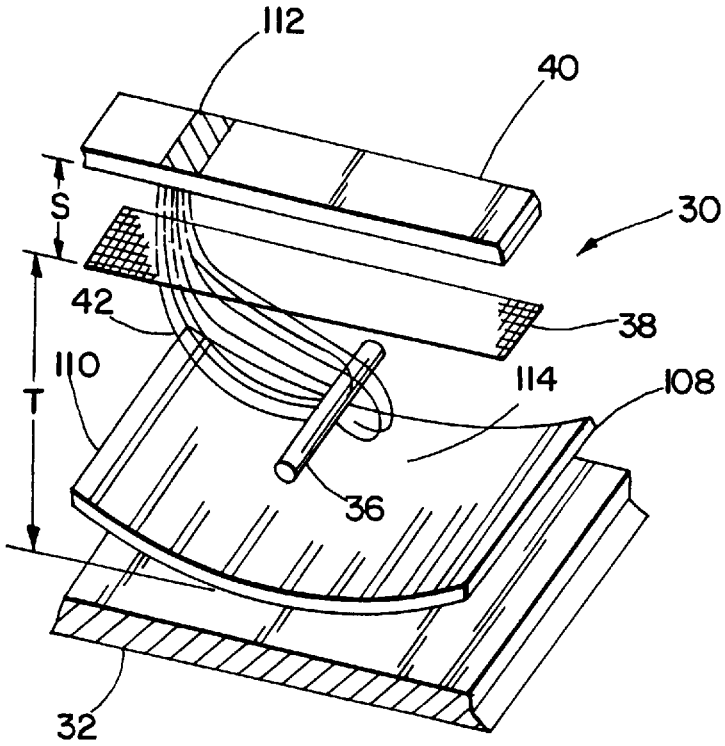
FIG. 10 is the embodiment of FIG. 9 in the scanning mode.

As shown in FIG. 10, "knife edge" 112 can be scanned across phosphor stripe 40. This is done by applying the appropriate voltages $V_{4i}$ to stripes 110. As before, these voltages can be determined by using the recursive method and making adjustments.

Figure 11:
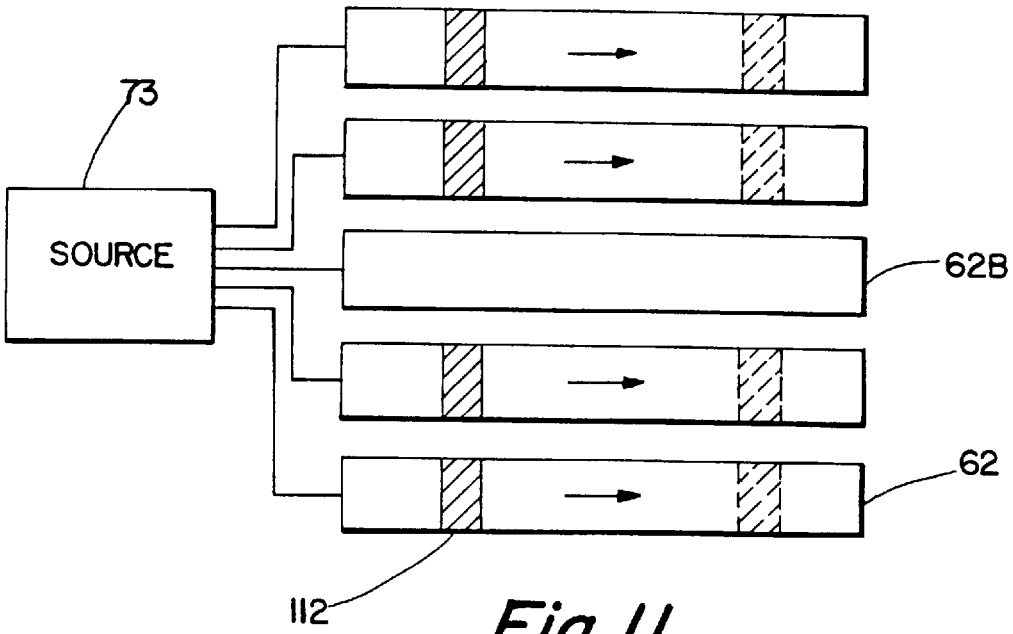
FIG. 11 is a top view illustrating the scanning of phosphor stripes by the "knife edge" beam.

FIG. 11 illustrates how "knife edge" 112 can be used in the embodiment of FIG. 5. For simplicity, only source 73 and phosphor stripes 62 are shown. The arrows indicate the sweeping movement of "knife edge" 112, whose width corresponds to that of a pixel, across five stripes 62. For illustration purposes all stripes 62 are maintained at accelerating voltage $V_1$ with the exception of stripe 62B. Consequently, no migrating pixel appears on stripe 62B.

SUMMARY

Many improvements can be added to the deflecting apparatus described above. The parabolic deflecting potential can be applied to portions or entire displays irrespective of their size. Also, the idea of guiding a "knife edge" can be used in scanning any suitable display system.

Therefore, the scope of the invention should be determined, not by examples given, but by the appended claims and their legal equivalents.

We claim:

1. A deflecting apparatus for a flat-panel display, said display comprising:

a) an evacuated display housing;

b) a display screen on the front face of said display housing, said display screen comprising phosphor stripes for generating visible radiation when bombarded with electrons;

c) means for applying an accelerating voltage $V_1$ to said phosphor stripes;

d) an elongate electron source positioned in the back of said evacuated display housing for emitting electrons;

e) an electron gating grid having plurality of conductive filaments arranged in parallel, said electron gating grid being positioned before said display screen;

f) means for selectively applying a blocking voltage $V_2$ and gating voltage $V_3$ to said conductive filaments, such that said gating voltage $V_3$ simultaneously applied to an adjacent filament pair of said conductive filaments to pass the electrons in-between said adjacent filament pair in the direction of said display screen;

and said deflecting apparatus comprising:

a) a deflecting means positioned at the back of said display housing a distance T below said electron gating grid such that said elongate electron source is located forward of said deflecting means, said deflecting means facing said elongate electron source; and b) a voltage control means for applying a steering potential $V_4$ to said deflecting means such that said deflecting means such that said deflecting means produces a spatially parabolic potential, thereby forcing the electrons moving in the direction of said anode grid to form a uniform beam.

2. The deflecting apparatus of claim 1, wherein said deflecting means comprises a number n of stripes positioned in parallel with said elongate electron source.

3. The deflecting apparatus of claim 2, wherein said stripes have variable widths.

4. The deflecting apparatus of claim 2, wherein said steering potential $V_4$ comprises a set of individual potentials $V_{4i}$, where i=1 . . . n, and said individual potentials $V_{4i}$, are applied to said stripes.

5. The deflecting apparatus of claim 4, wherein said individual potentials $V_{4i}$ are applied to produce narrow electron beam in the shape of a knife edge.

6. The deflecting apparatus of claim 1, wherein said distance T is chosen such that said uniform beam has a uniform cross section when passing through said electron gating grid.

7. The deflecting apparatus of claim 1, wherein said elongate source of electrons comprises a filament for emitting thermal electrons.

8. The deflecting apparatus of claim 1, wherein said filament extend extends along the focal line of said spatially parabolic potential.

9. A deflecting apparatus for a flat-panel display, said display so comprising:

a) an evacuated display housing;

b) a display screen on the front face of said display housing, said display screen comprising phosphor stripes generating visible radiation when bombarded with electrons;

c) means for applying an accelerating voltage $V_1$ to said phosphor stripes;

d) an elongate electron source positioned in the back of said evacuated display housing for emitting electrons;

e) an electron gating grid having a plurality of conductive filaments arranged in parallel, said electron gating grid being positioned before said display screen;

f) means for selectively applying a blocking voltage $V_2$ and a gating voltage $V_3$ to said conductive filaments, such that said gating voltage $V_3$ is simultaneously applied to an adjacent filament pair of said conductive filaments to pass the electrons in-between said adjacent filament pair in the direction of said display screen; and said deflecting apparatus comprising:

a) a parabolic deflector positioned at the back of said display housing a distance T below said anode grid such that said elongate electron source is located forward of said parabolic deflector; and b) a voltage control means for maintaining said parabolic deflector at a steering potential $V_4$, such that said parabolic deflector produces a spatially parabolic potential, thereby forcing the electrons moving in the direction of said anode grid to form a uniform beam.

10. The deflecting apparatus of claim 9, wherein said distance T is chosen such that said uniform beam has a uniform cross section when passing through said electron gating grid.

11. The deflecting apparatus of claim 9, wherein said elongate source of electrons comprises a filament for emitting thermal electrons.

12. The deflecting apparatus of claim 11, wherein said filament extends along the focal line of said parabolic deflector.

13. A deflecting apparatus for a flat-panel display, said display comprising:

a) an evacuated display housing, b) a display screen on the front face of said display housing, said display screen comprising phosphor stripes for generating visible radiation when bombarded with electrons, c) means for applying an accelerating voltage $V_1$ to said phosphor stripes;

d) an elongate electron source positioned in the back of said evacuated display housing for emitting electrons, e) an anode grid positioned before said display screen, f) means for applying predetermined voltages to said anode grid, such that the electrons pass through said anode grid in the direction of said display screen and said deflecting apparatus comprising:

a) a number n of stripes of variable widths positioned in parallel with said elongate electron source positioned at the back of said display housing a distance T below said anode grid such that said elongate electron source is located forward of said stripes, said stripes facing said elongate electron source, and b) a voltage control means for applying a steering potential $V_4$ to said stripes such that said stripes produces a spatially parabolic potential, thereby forcing the electrons moving in the direction of said anode grid to form a uniform beam.

14. A deflecting apparatus for a flat-panel display, said display comprising:

a) an evacuated display housing, b) a display screen on the front face of said display housing, said display screen comprising phosphor stripes for generating visible radiation when bombarded with electrons, c) means for applying an accelerating voltage $V_1$ to said phosphor stripes;

d) an elongate electron source positioned in the back of said evacuated display housing for emitting electrons, e) an anode grid positioned before said display screen, f) means for applying predetermined voltages to said anode grid, such that the electrons pass through said anode grid in the direction of said display screen and said deflecting apparatus comprising:

a) a number n of stripes positioned in parallel with said elongate electron source positioned at the back of said display housing a distance T below said anode grid such that said elongate electron source is located forward of said stripes, said stripes facing said elongate electron source, and b) a voltage control means for applying a set of individual steering potentials $V_{4i}$, where i=1 . . . n, and said individual potentials $V_{4i}$ are applied to said stripes to produce a narrow electron beam in the shape of a knife edge.

* * * * *